US011644273B1

(12) United States Patent
Hughes

(10) Patent No.: US 11,644,273 B1
(45) Date of Patent: May 9, 2023

(54) PISTOL SLIDE RACKING TOOL

(71) Applicant: Francis A Hughes, Little Egg Harbor, NJ (US)

(72) Inventor: Francis A Hughes, Little Egg Harbor, NJ (US)

( * ) Notice: Subject to any disclaimer, the term of this patent is extended or adjusted under 35 U.S.C. 154(b) by 0 days.

(21) Appl. No.: 17/804,608

(22) Filed: May 31, 2022

(51) Int. Cl.
*F41C 27/00* (2006.01)

(52) U.S. Cl.
CPC ..... *F41C 27/00* (2013.01)

(58) Field of Classification Search
CPC .. F41C 27/00; F41C 23/10; F41C 3/00; F41A 3/10; F41A 3/72
See application file for complete search history.

(56) References Cited

U.S. PATENT DOCUMENTS 1,680,186 A * 8/1928 Von Frommer ..... F41A 3/66 42/106
8,191,301 B2 * 6/2012 Hatfield ..... F41C 27/00 42/90
8,312,803 B2 * 11/2012 Oz ..... F41A 3/72 89/1.4
8,438,774 B2 * 5/2013 Sharp ..... F41C 27/00 42/90
8,468,734 B2 * 6/2013 Meller ..... F41C 3/00 89/1.4
8,549,785 B2 * 10/2013 Sharp ..... F41C 27/00 42/90
9,194,636 B2 * 11/2015 McAninch ..... F41A 19/52
9,194,654 B1 * 11/2015 Viani ..... F41C 27/00
9,239,207 B2 * 1/2016 Kresser ..... F41C 3/00
9,291,413 B1 * 3/2016 Viani ..... F41A 3/72
9,328,991 B2 * 5/2016 Gale ..... F41G 11/003
D761,374 S * 7/2016 Ellsworth ..... D22/108
9,587,905 B1 * 3/2017 Biedenbach ..... F41C 23/16
9,791,226 B1 * 10/2017 Bozzo ..... F41A 3/22
9,995,544 B1 * 6/2018 Akimov ..... F41A 3/72
10,782,081 B2 * 9/2020 Porat ..... F41A 3/72
11,287,199 B1 * 3/2022 Cahill ..... F41A 3/72
11,549,768 B1 * 1/2023 Pischke ..... F41A 3/72
2012/0198744 A1 * 8/2012 Meller ..... F41C 27/00 42/90
2013/0081318 A1 * 4/2013 Morando ..... F41A 35/00 42/108
2015/0184959 A1 * 7/2015 Parnell ..... F41A 3/72 89/1.4
2015/0354909 A1 * 12/2015 Tarantino ..... F41A 3/72 89/1.4
2016/0102938 A1 * 4/2016 Sroufe ..... F41C 3/00 42/16
2023/0081853 A1 * 3/2023 Butler ..... F41C 23/04

* cited by examiner

*Primary Examiner* — Michelle Clement
(74) *Attorney, Agent, or Firm* — Stuart M. Goldstein

(57) ABSTRACT

A pistol slide racking tool has a main body with a threaded passageway through its upper section. Tapered lateral arm members extend from the upper section. Tapered attachment pads are located adjacent to each arm member. A shaft threadably engages the passageway through the main body. The shaft is connected to a handle at one end and, at the opposite end of the shaft, is in contact with a mid-linkage member located in the passageway. In order to rack the slide, the attachment pads are positioned adjacent to the sides of the slide. The shaft is rotated to move the mid-linkage member and attachment pads forward such that they are tight against the slide. Movement of the handle in the direction away from the pistol then racks the slide.

3 Claims, 4 Drawing Sheets

PISTOL SLIDE RACKING TOOL

FIELD OF THE INVENTION

The present invention relates to a tool which assists in racking the slide of an automatic pistol.

BACKGROUND OF THE INVENTION

Semi-automatic weapons, such as the High Standard pistol, utilize slides in the bullet loading and firing process. In loading a bullet from the pistol's magazine into its firing chamber, the slide must be pulled back to allow the uppermost bullet in the magazine to be forced into the chamber. This "racking" process is essential in the operation of a semi-automatic weapon like the High Standard and similar pistols.

However, racking the slide of a pistol requires a great deal of manual pulling force. Aged, arthritic, disabled, weaker users, or even those with small hands may not have enough strength to rack the slide. For these individuals, grasping the sides of a slide may not be sufficient to pull it back. And an improperly racked slide could be dangerous, causing the pistol to unilaterally and accidentally discharge.

Many different types of pistol attachments and devices have been proposed to assist an individual in racking the slide of a semi-automatic pistol. However, most of these prior slide assistance means comprise extraneous components which must be attached to the slide or other parts of the pistol. These still often require a certain amount of pulling force to rack the slide. In addition, such components positioned on the weapon itself, create weapon instability, making it difficult to accurately aim and shoot. Attachments also increase the overall size of the weapon, which may not allow it to fit into its holster.

SUMMARY OF THE INVENTION

It is thus the object of the present invention to provide a pistol slide racking tool which can be simply positioned on the slide of a semi-automatic pistol in order to allow a user to easily rack the weapon.

These and other objects are accomplished by the present invention, a pistol slide racking tool having a main body with a threaded passageway through the upper section of the main body. Two lateral arm members extend from the upper section, the inside surfaces of the arm members being tapered inward towards the end of the arm members. A tapered attachment pad is positioned adjacent to the inside surface of each arm member for placement adjacent to opposite sides of a pistol slide. A cross brace extends between the arm members. A mid-linkage member is connected to the cross brace and extends into the passageway. A shaft threadably engages the passageway through the main body and into an opening between the arm members, the shaft being connected to a handle at one end of the shaft and in contact with the mid-linkage member at the opposite end of the shaft. In order to rack the slide, the attachment pads are positioned adjacent to the sides of the slide. The shaft is rotated causing a mid-linkage member connected to the attachment pads to move the pads forward such that they are tight against the slide. Movement of the handle in the direction away from the pistol racks the slide.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1A:
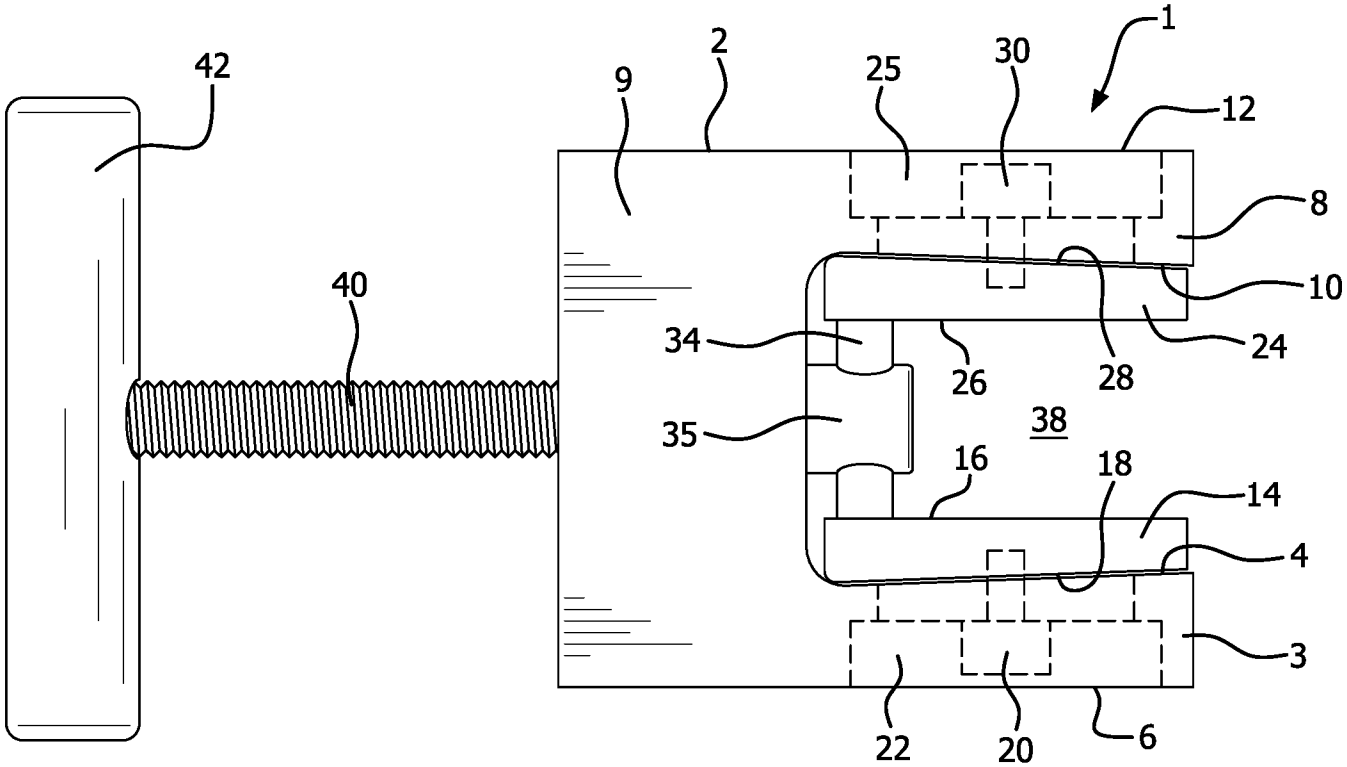
FIG. 1A is a top view of the pistol slide racking tool of the present invention in its retracted position.

The pistol slide racking tool of the present invention 1 comprises main body 2 having first lateral arm member 3 with linear inside surface 4 and linear outside surface 6 and second lateral arm member 8 with linear inside surface 10 and linear outside surface 12. Inside surfaces 4 and 10 are tapered towards the end of their respective arm members 2 and 8. Lateral arm member 3 and lateral arm member 8 extend from upper section 9 of main body 2. Threaded passageway 11 is located through upper section 9.

First tapered attachment pad 14 has inside surface 16 and linear outside surface 18 positioned adjacent to inside surface 4 of arm member 3. An extended screw or like tab member 20 extends outward from tapered attachment pad 14 into slot 22 of first arm member 3. Second tapered attachment pad 24 has linear inside surface 26 and linear outside surface 28 positioned adjacent to inside surface 10 of arm member 8. An extended screw or like tab member 30 extends outward from tapered attachment pad 24 into slot 25 of second arm member 8. Cross brace 34 extends between and is connected at its ends to first attachment pad 14 and second tapered attachment pad 24. Mid-linkage member 35 is connected to cross brace 34 and extends into passageway 11.

Opening 38 is located between first arm member 3 and second arm member 8. First attachment pad 14, second attachment pad 24, cross brace 34, and mid-linkage member are located within opening 38.

Figure 1B:
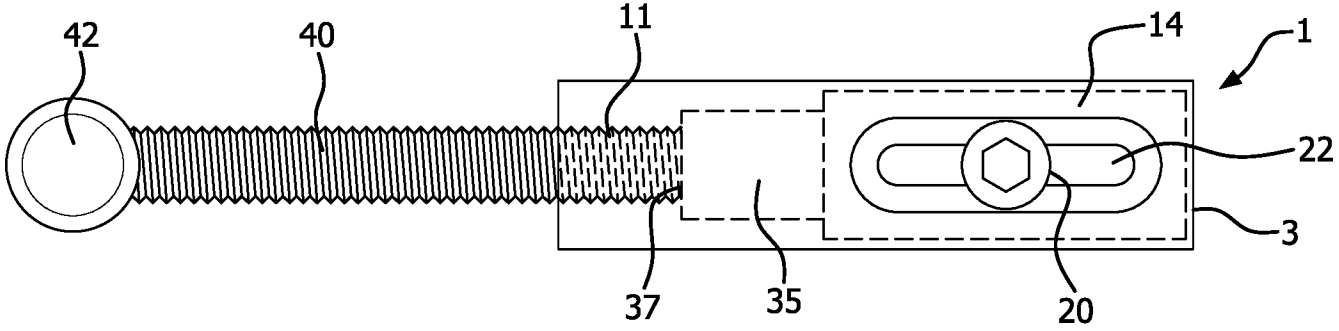
FIG. 1B is an elevation view of the pistol slide racking tool of the present invention in its retracted position.
Figure 2A:
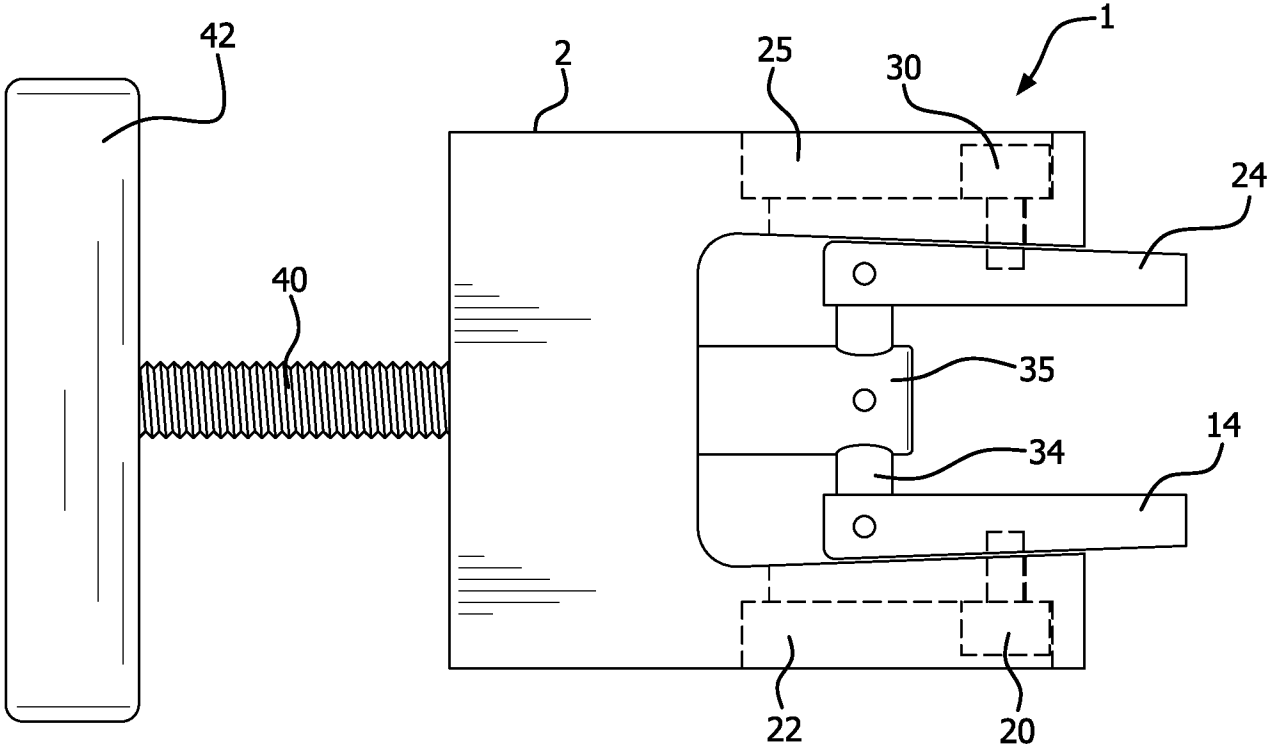
FIG. 2A is a top view of the pistol slide racking tool of the present invention in its extended position.
Figure 2B:
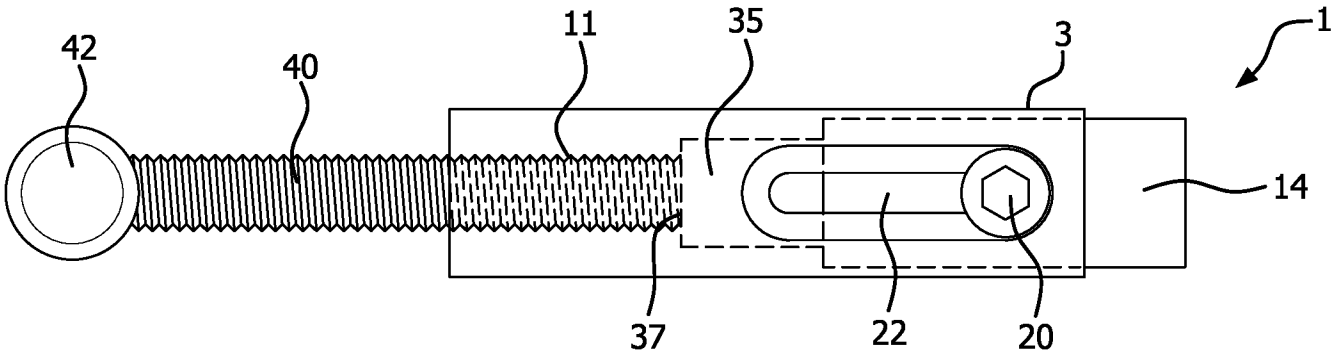
FIG. 2B is an elevation view of the pistol slide racking tool of the present invention in its extended position.

Threaded shaft 40 extends into passageway 11 in upper section 9 of main body 2 where it is threadably engaged into the passageway. Shaft 40 has handle 42 at one of its ends and it contacts mid-linkage member 35 at its opposite end 37 as best seen in FIGS. 1B and 2B.

Figure 3:
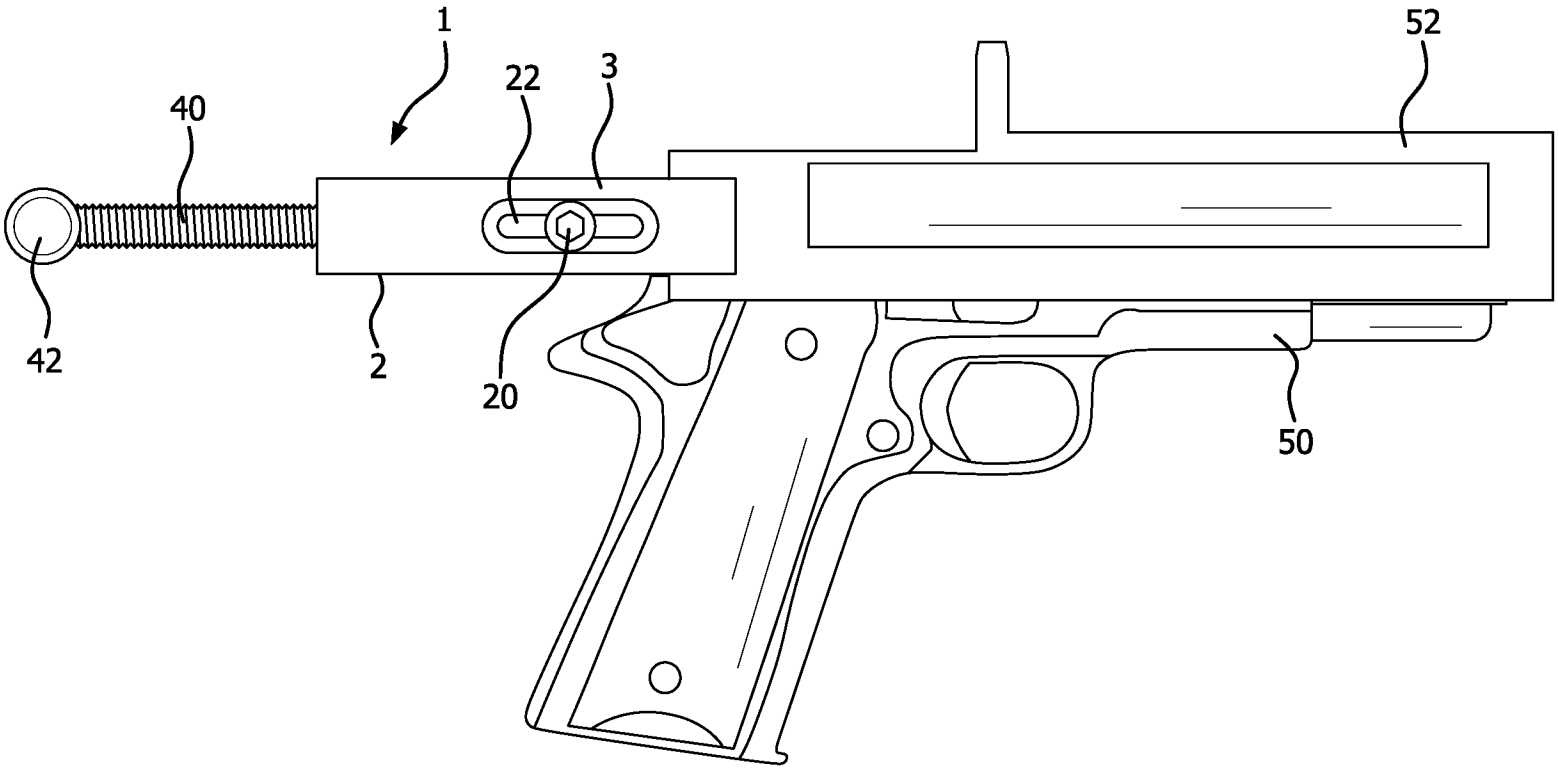
FIG. 3 is an elevation view illustrating the positioning of the pistol slide racking tool of the present invention placed on the sides of a pistol slide, prior to racking a pistol.
Figure 4:
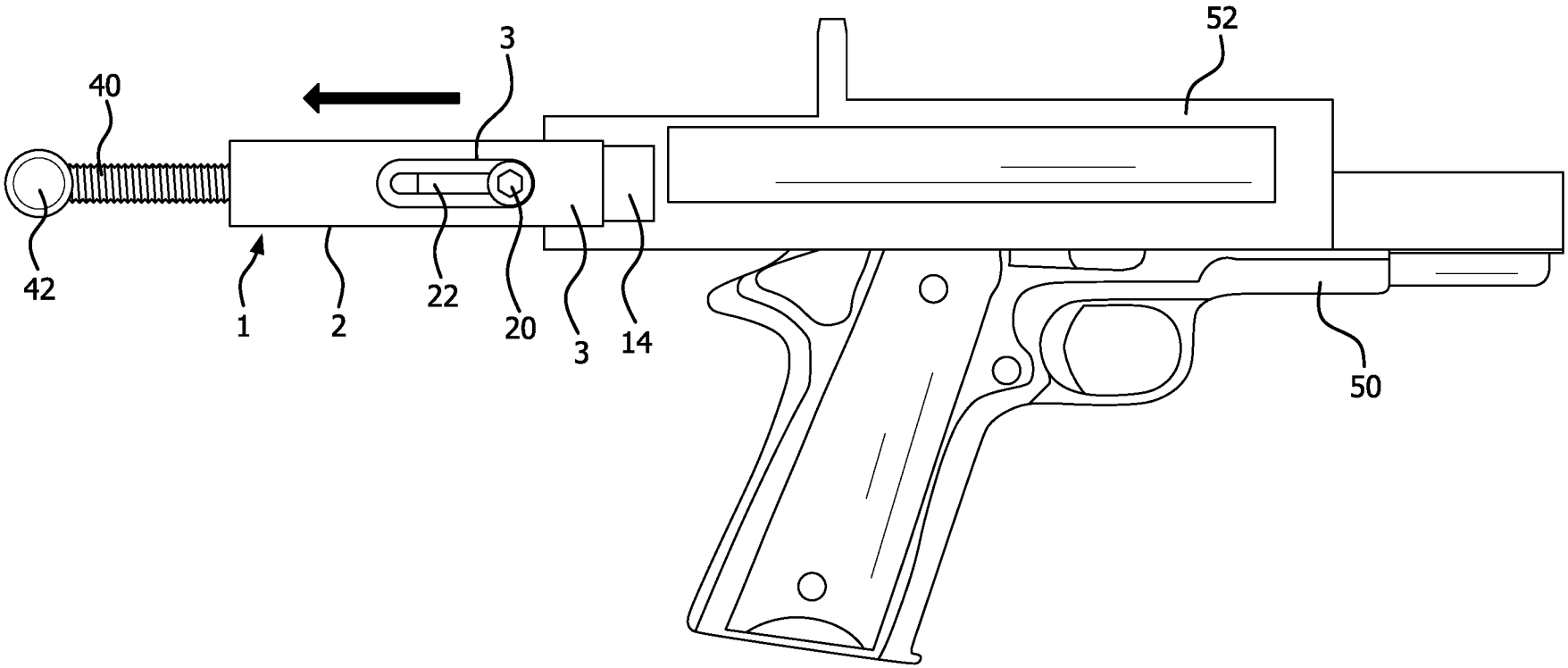
FIG. 4 is an elevation view illustrating the pistol slide racking tool of the present invention accomplishing the racking of a pistol.

In order to rack slide 52 on semi-automatic pistol 50, racking tool 1 is positioned on the slide such that tapered attachment pads 14 and 24 are placed alongside of the slide, as seen in FIG. 3. Rotating handle 42 causes threaded shaft 40 to be screwed into threaded passageway 11. When end 37 of shaft 40 contacts mid-linkage member 35, the mid-linkage member is pushed forward, which in turn pushes cross brace 34 and hence attachment pads 14 and 24 toward slide 52. Tab members 20 and 30 in their respective slots assist in the straight and linear movement of attachment pads 14 and 24 within opening 38. Given the tapered shape of attachment pads 14 and 24, when the attachment pads are compelled forward they become tight against the sides of slide 52. This allows handle 42 to be pulled in the direction away from pistol 50 thus racking slide 52.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A pistol slide racking tool for racking the slide of a pistol, the tool comprising:

a main body having an upper section having a threaded passageway therethrough, and first and second lateral arm members extending from the upper section, each arm member having a linear inside surface and a linear outside surface, the inside surfaces of the arm members being tapered inward towards the ends of the arm members;

a first tapered attachment pad having a linear outside surface positioned adjacent to the inside surface of the first arm member and an inside surface for placement adjacent to one side of the slide;

a second tapered attachment pad having a linear outside surface positioned adjacent to the inside surface of the second arm member and an inside surface for placement adjacent to the opposite side of the slide;

a cross brace extending between and connected to the first and second attachment pads;

an opening between the first and second arm members in which the first and second attachment pads and the cross brace are located;

a threaded shaft having a handle at one of its ends, the shaft extending through the upper section of the main body and being threadably engaged within the passageway;

wherein with the inside surfaces of the first and second attachment pads positioned adjacent to the sides of the slide and the outside surfaces of the first and second attachment pads positioned adjacent to the inside surfaces of the first and second arm members, rotation of the handle and hence the shaft screws the shaft into the passageway and tightens the attachment pads against the sides of the slide such that pulling the handle in the direction away from the pistol racks the slide.

2. The pistol racking tool as in claim 1 further comprising a mid-linkage member connected to the cross brace and extending into the passageway, wherein continued rotation of the handle and hence the shaft contacts said mid-linkage member and compels the cross brace and first and second attachment pads towards the slide.

3. The pistol racking tool as in claim 1 wherein the first and second arm members each have a slot and the first and second attachment pads each have an outwardly extending tab member, the tab member extending from the first attachment pad located within the slot of the first arm member and the tab member extending from the second attachment pad located within the slot of the second arm member, the tab members within the slots assisting in the straight, linear movement of the attachment pads within the opening.

* * * * *